US005582462A

United States Patent [19]

Shea

[11] Patent Number: 5,582,462

[45] Date of Patent: Dec. 10, 1996

[54] SAFETY HIGHCHAIR

[76] Inventor: Claire M. Shea, 171 Charger St., Revere, Mass. 02151

[21] Appl. No.: 452,983

[22] Filed: May 30, 1995

[51] Int. Cl.[6] ..... A47D 15/00

[52] U.S. Cl. ..... 297/467; 297/484

[58] Field of Search ..... 297/467, 484

[56] References Cited

U.S. PATENT DOCUMENTS

| | | | |
|---|---|---|---|
| 3,216,738 | 11/1965 | Bockus | 297/467 X |
| 4,040,664 | 8/1977 | Tanaka et al. | 297/467 |
| 4,936,628 | 6/1990 | Delaney et al. | 297/256.15 |
| 5,039,169 | 8/1991 | Bougher et al. | 297/467 X |
| 5,161,522 | 11/1992 | Clevenger | 297/484 X |
| 5,230,523 | 7/1993 | Wilhelm | 297/250.1 X |

FOREIGN PATENT DOCUMENTS

| | | | |
|---|---|---|---|
| 1595570 | 8/1981 | United Kingdom | 297/DIG. 4 |

*Primary Examiner*—Peter R. Brown

[57] ABSTRACT

A safety highchair including a seat; a leg supporting mechanism extended downwards from the seat for holding the seat in an elevated orientation upon a recipient surface; a seat back coupled to the seat and extended upwards therefrom to define a generally L-shaped seating configuration; an adjustable Y-shaped shoulder harness including a pair of upper strap members coupled to a lower strap member and with each strap member having a free end; an upper shoulder harness coupling mechanism for adjustably coupling the free ends of the upper strap members to the seat back; and a lower shoulder harness coupling mechanism for adjustably coupling the free end of the lower strap member to the seat in a closed loop arrangement with respect to the seating configuration.

1 Claim, 4 Drawing Sheets

SAFETY HIGHCHAIR

BACKGROUND OF THE INVENTION

1. Field of the Invention

The present invention relates to a safety highchair and more particularly pertains to restraining a child when sitting and thereby protecting the child from falling with a safety highchair.

2. Description of the Prior Art

The use of safety chair mechanisms is known in the prior art. More specifically, safety chair mechanisms heretofore devised and utilized for the purpose of restraining a child when sitting are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 298,366 to Zimmerman discloses an infant harness or the like. U.S. Pat. No. 4,666,017 to Zimmerman discloses an infant harness or the like. U.S. Pat. No. 5,115,523 to Cone discloses a convertible infant restraint device. U.S. Pat. No. 5,183,311 to Meeker et al. discloses a portable highchair/booster seat. U.S. Pat. No. 5,294,185 to Koyanagi et al. discloses a restraining protective seat for infants. U.S. Pat. No. 5,325,818 to Leach discloses a safety harness for infants and toddlers.

While these devices fulfill their respective, particular objective and requirements, the aforementioned patents do not describe a safety highchair that allows a child to be securely emplaced in a highchair and thereby minimizing the possibility of the child falling from the chair.

In this respect, the safety highchair according to the present invention substantially departs from the conventional concepts and designs of the prior art, and in doing so provides an apparatus primarily developed for the purpose of restraining a child when sitting and thereby protecting the child from falling.

Therefore, it can be appreciated that there exists a continuing need for new and improved safety highchair which can be used for restraining a child when sitting and thereby protect the child from falling. In this regard, the present invention substantially fulfills this need.

SUMMARY OF THE INVENTION

In the view of the foregoing disadvantages inherent in the known types of safety chair mechanisms now present in the prior art, the present invention provides an improved safety highchair. As such, the general purpose of the present invention, which will be described subsequently in greater detail, is to provide a new and improved safety highchair and method which has all the advantages of the prior art and none of the disadvantages.

To attain this, the present invention essentially comprises, in combination, a generally planar rigid rectangular seat having an upper surface, a lower surface, a periphery interconnecting the surfaces formed of a short back edge, a short front edge, and a pair of opposed long side edges. The seat further has a longitudinal central axis disposed therethrough and a groove formed on the upper surface thereof and aligned along a portion of the central axis at a location near the front edge. The groove is bounded by a bottom surface portion and a pair of angled side surface portions. The bottom surface portion of the groove additionally has a sequence of spaced holes formed centrally therealong. Four straight rigid legs are included with each leg having an upper end coupled to a corner of the lower surface of the seat. Each leg is extended angularly downwards and terminated at a lower free end that is positionable upon a recipient supporting surface. A rigid horizontal bracing element is provided and coupled between at least two of the legs. A generally rectangular rigid seat back is included. The seat back is coupled to the back edge of the seat and extended upwards therefrom to define a generally L-shaped seating configuration. The seat back has an inboard surface, an outboard surface, a pair of opposed long side edges, a curved short top edge, a longitudinal central axis disposed therethrough, two pairs of spaced vertically positioned slots formed thereon that are symmetrically aligned about the central axis, and a pair of spaced and horizontally aligned buckle mechanisms coupled to the outboard surface at a location below the slots that are symmetrically aligned about the central axis. A pair of arms is included and extended between the seat and the seat back to define a space therebetween for holding a sitting child. Each arm has an elongated horizontal long upper rail with a back end coupled to the seat back at a location near one of the side edges thereof, a rounded free front end, and an intermediate portion therebetween. Each arm further has an elongated vertical short lower rail with an upper end coupled to the intermediate portion of the upper rail and a lower end coupled to the upper surface of the seat at a location near one of the side edges of the seat. Each upper rail of each arm additionally has an elongated and longitudinally positioned brace coupled thereto and with each brace having a groove formed thereon.

A rigid planar tray is included and has an upper surface, a lower surface, and a periphery interconnecting the surfaces formed of a long curved front edge, a short curved back edge, and a pair of end edges. The tray further includes a pair of spaced parallel elongated beams coupled thereto and extended downwards from the lower surface. The beams are slidably inserted within the grooves of the braces on the arms for removably coupling the tray at a location forward of the space and the seating configuration. Lastly, a Y-shaped shoulder harness is provided. The shoulder harness includes of a pair of upper strap members adjustably coupled to a lower strap member with a fastener. Each strap member has a free end. The free end of the lower strap is formed in a loop. Each of the free ends of the upper strap members is adjustably extended within one of the slots and terminated with a complementary buckle mechanism. Each complementary buckle mechanism is securable with one of the buckle mechanisms of the seat in a closed loop configuration. The shoulder harness further includes a latch coupled to the free end of the lower strap member with a pair of opposed pins. The latch includes a bracket with a bottom wall, a U-shaped sidewall extended upwards from the bottom wall, and a rail extended downwards from the bottom wall and slidably inserted within the groove of the seat. The latch additionally includes a T-shaped spring-loaded rigid bolt extended through the bottom wall and rail of the bracket. The bolt has a handle formed at an upper extent thereof and a point formed at a lower extent thereof and with the point of the bolt removably inserted within one of the holes of the seat for placing the harness in a closed loop arrangement with respect to the seating configuration.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved safety highchair which has all the advantages of the prior art safety chair mechanisms and none of the disadvantages.

It is another object of the present invention to provide a new and improved safety highchair which may be easily and efficiently manufactured and marketed.

It is a further object of the present invention to provide a new and improved safety highchair which is of durable and reliable construction.

An even further object of the present invention is to provide a new and improved safety highchair which is susceptible of a low cost of manufacture with regard to both materials and labor, and which accordingly is then susceptible of low prices of sale to the consuming public, thereby making such a safety highchair economically available to the buying public.

Still yet another object of the present invention is to provide a new and improved safety highchair which provides in the apparatuses and methods of the prior art some of the advantages thereof, while simultaneously overcoming some of the disadvantages normally associated therewith.

Even still another object of the present invention is to provide a new and improved safety highchair for restraining a child when sitting and thereby protecting the child from falling.

Lastly, it is an object of the present invention to provide a new and improved safety highchair comprising a seat; leg supporting means extended downwards from the seat for holding the seat in an elevated orientation upon a recipient surface; a seat back coupled seat and extended upwards therefrom to define a generally L-shaped seating configuration; an adjustable Y-shaped shoulder harness including of a pair of upper strap members coupled to a lower strap member and with each strap member having a free end; upper shoulder harness coupling means for adjustably coupling the free ends of the upper strap members to the seat back; and lower shoulder harness coupling means for adjustably coupling the free end of the lower strap member to the seat in a closed loop arrangement with respect to the seating configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
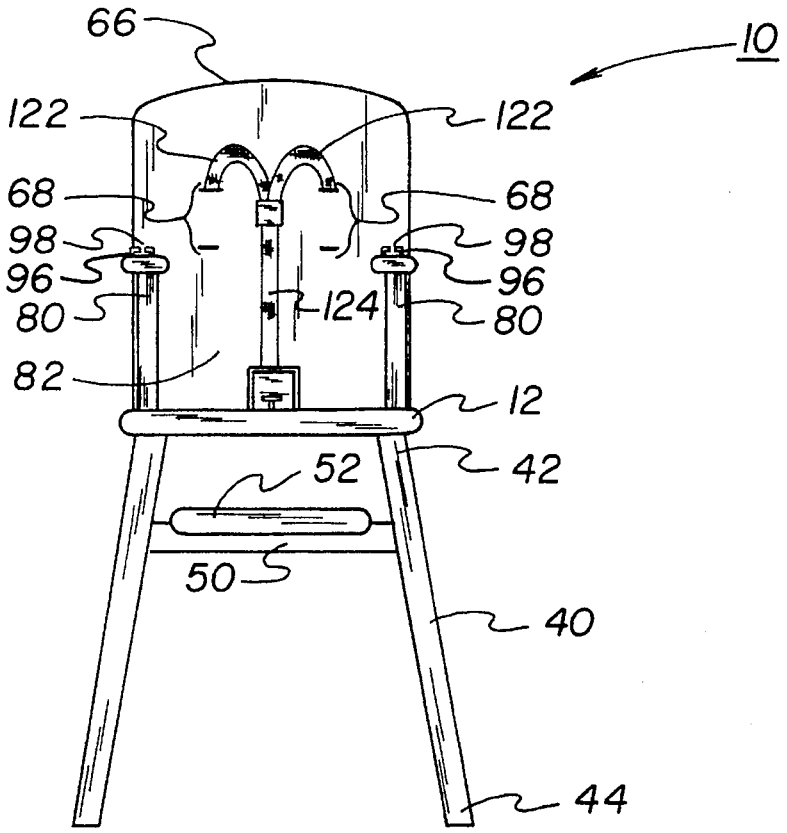
FIG. 1 is a front view of the preferred embodiment constructed in accordance with the principles of the present invention.

With reference now to the drawings, and in particular, to FIG. 1 thereof, the preferred embodiment of the new and improved safety highchair embodying the principles and concepts of the present invention and generally designated by the reference number 10 will be described.

The preferred embodiment of the present invention comprises a plurality of components. In their broadest context, such components include a seat, legs, bracing element, seat back, arms, tray, and harness. Such components are individually configured and correlated with respect to each other to provide the intended function of restraining a child when sitting and thereby protecting the child from falling.

Figure 4:
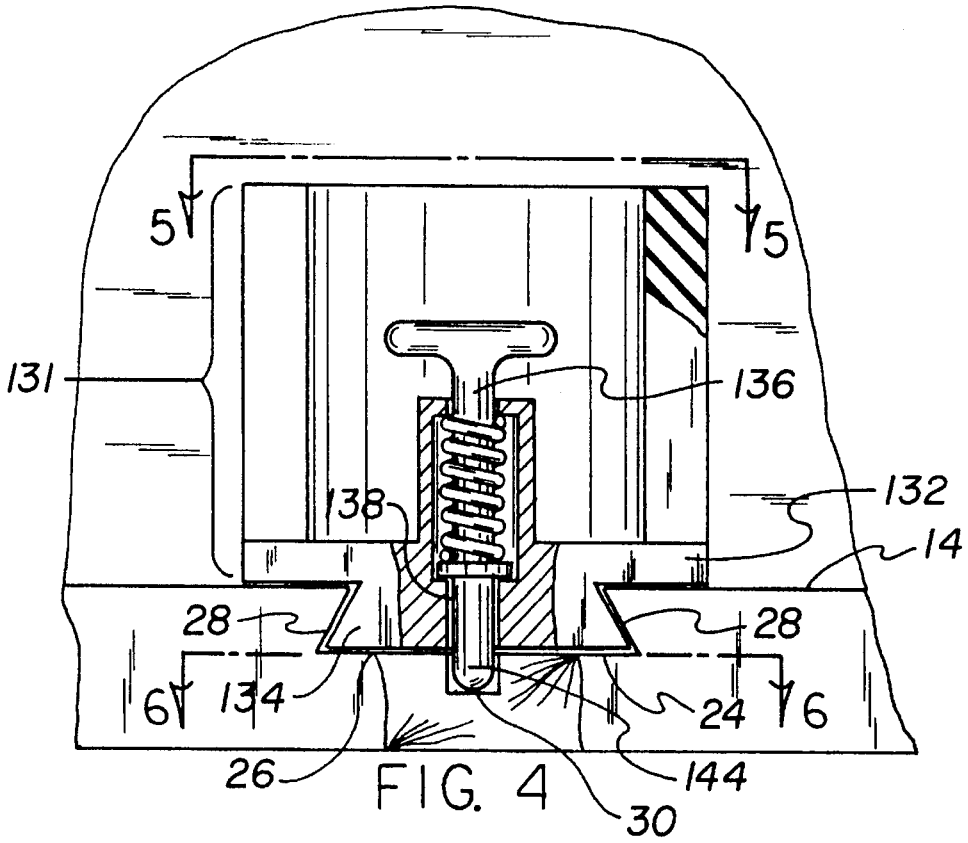
FIG. 4 is a cross-sectional view of the coupling of the buckle and the seat taken along the line 4—4 of FIG. 2.
Figure 6:
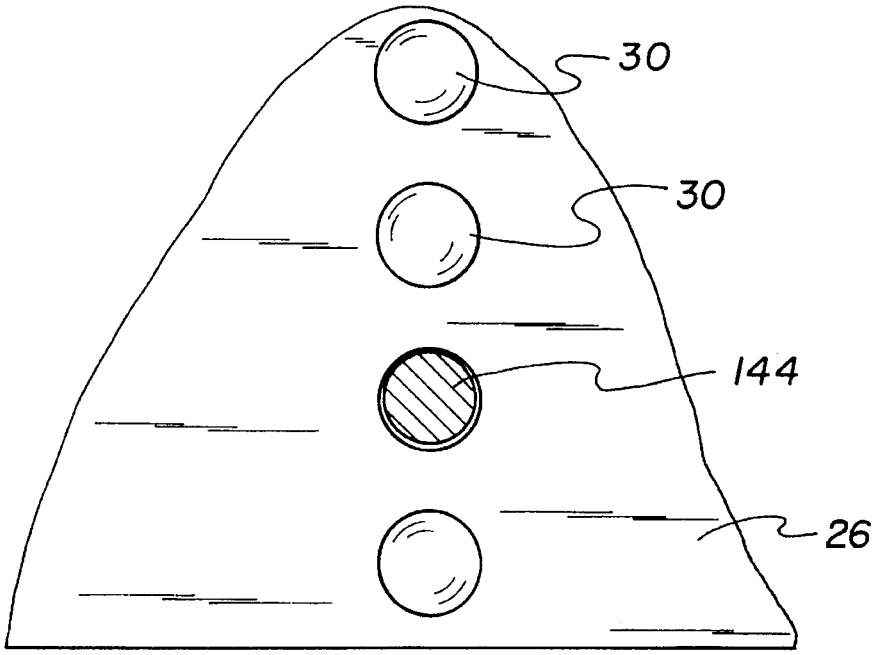
FIG. 6 is a view of the sequence of holes formed on the seat taken along the line 6—6 of FIG. 4.

Specifically, the present invention includes a seat 12. The seat is generally planar, rigid, and rectangular in structure. As shown in FIG. 1, the seat has an upper surface 14, a lower surface 16, and a periphery interconnecting the surfaces. The periphery is formed of a short back edge 18, a short front edge 20, and a pair of opposed long side edges 22. The seat also has a longitudinal central axis disposed therethrough and a groove 24 formed on the upper surface thereof as shown in FIG. 4. The groove is aligned along a portion of the central axis at a location near the front edge 20. The groove is bounded by a bottom surface portion 26 and a pair of angled side surface portions 28. Each of the side surface portions forms an angle of about between about 50 and 60 degrees with the bottom surface portion 26. Each side edge has an upper extent and a lower extent. The upper extents of the side edges are positioned closer together than the lower extents of the side edges to define a general inverted V-shape. The bottom surface portion 26 of the groove additionally has a linear sequence of spaced holes 30 formed centrally therealong as shown in FIG. 6.

Four straight rigid legs 40 are included as best illustrated in FIG. 1. Each leg has an upper end 42 coupled to a corner of the lower surface 16 of the seat. Each leg is extended angularly downwards and outwards from the seat. Each leg forms an angle of between about 2 and 10 degrees with the vertical. Each leg is terminated at a lower free end 44. The lower free ends of the legs are positionable on a recipient supporting surface for placing the seat 12 in an elevated and generally level orientation for use by a child.

To provide the present invention with additional rigidity and stability, a rigid horizontal bracing element 50 is coupled between at least two of the legs 40. In the preferred embodiment, the pair of legs near the front edge 20 has the bracing element 50 secured therebetween. Additionally, a foot rest 52 can be provided and coupled to the bracing element. The foot rest provides a surface on which a child's feet can rest when the child is sitting in the chair.

Figure 2:
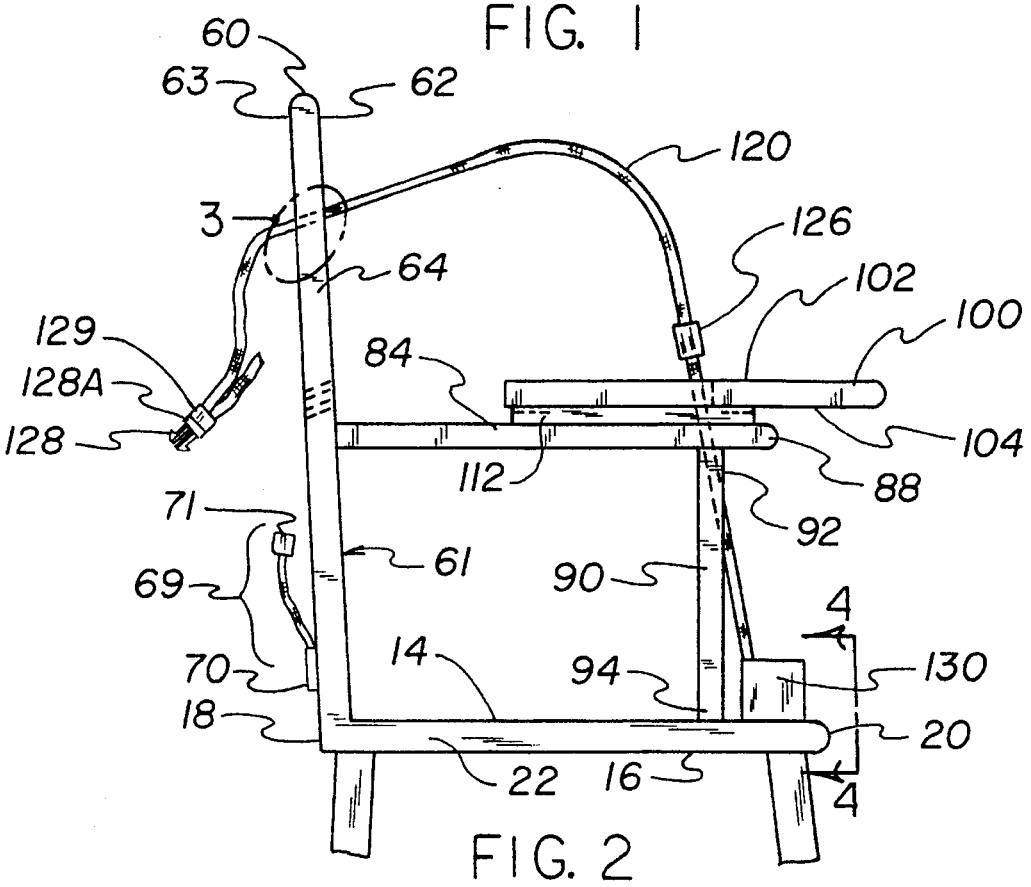
FIG. 2 is a side-elevational view of an upper extent of the present invention.
Figure 3:
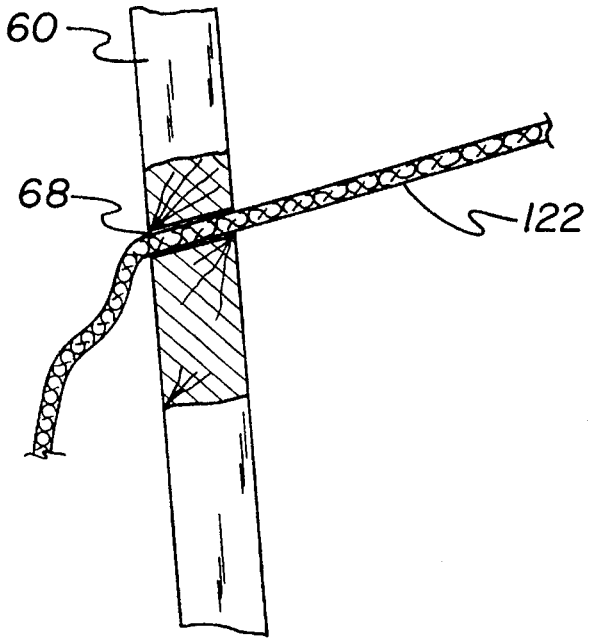
FIG. 3 is an enlarged fragmentary cross-sectional view of the coupling of the harness with the seat back of the present invention.

Coupled to the back edge 18 of the seat 12 and extended upwards therefrom is a generally rectangular rigid seat back 60 as shown in FIG. 3. The seat back in combination with the seat 12 defines a generally L-shaped seating configuration 61 as illustrated in FIG. 2. The seat back forms an angle of about between about 3 and 5 degrees with the vertical. As shown in FIGS. 1 and 2, the seat back has an inboard surface 62, and outboard surface 63, a pair of opposed long side edges 64, a curved short top edge 66, and a longitudinal central axis disposed therethrough. In addition, two pairs of spaced and vertically positioned slots 68 are formed on the seat back. The pairs of slots are symmetrically aligned about the central axis. A pair of spaced and horizontally aligned buckle mechanisms 69 is also provided. Each buckle mechanism includes fabric strap portion 70 that is coupled to the outboard surface 63 of the seat back and is further terminated with a socket portion 71. The buckle mechanisms 69 are symmetrically aligned about the central axis of the seat back at a location below the slots.

A pair of opposed and rigid arms 80 is extended between the seat 12 and the seat back 60 as shown in FIG. 1 to define a space 82 therebetween for holding a sitting child in a contained position. As depicted in FIG. 2, each arm 80 has an elongated horizontal long upper rail 84 with a back end 86 coupled to the seat back 60 at a location near one of the side edges 64, a rounded free front end 88, and an intermediate portion therebetween. Each arm further has an elongated vertical short lower rail 90 with an upper end 92 coupled to the intermediate portion of the upper rail and a lower end 94 coupled to the upper surface 14 of the seat at a location near one of the side edges 22. Each upper rail 84 of each arm 80 additionally has an elongated and longitudinally positioned brace 96 coupled thereto as shown in FIG. 1. Each brace 96 has a groove 98 formed longitudinally thereon.

Figure 7:
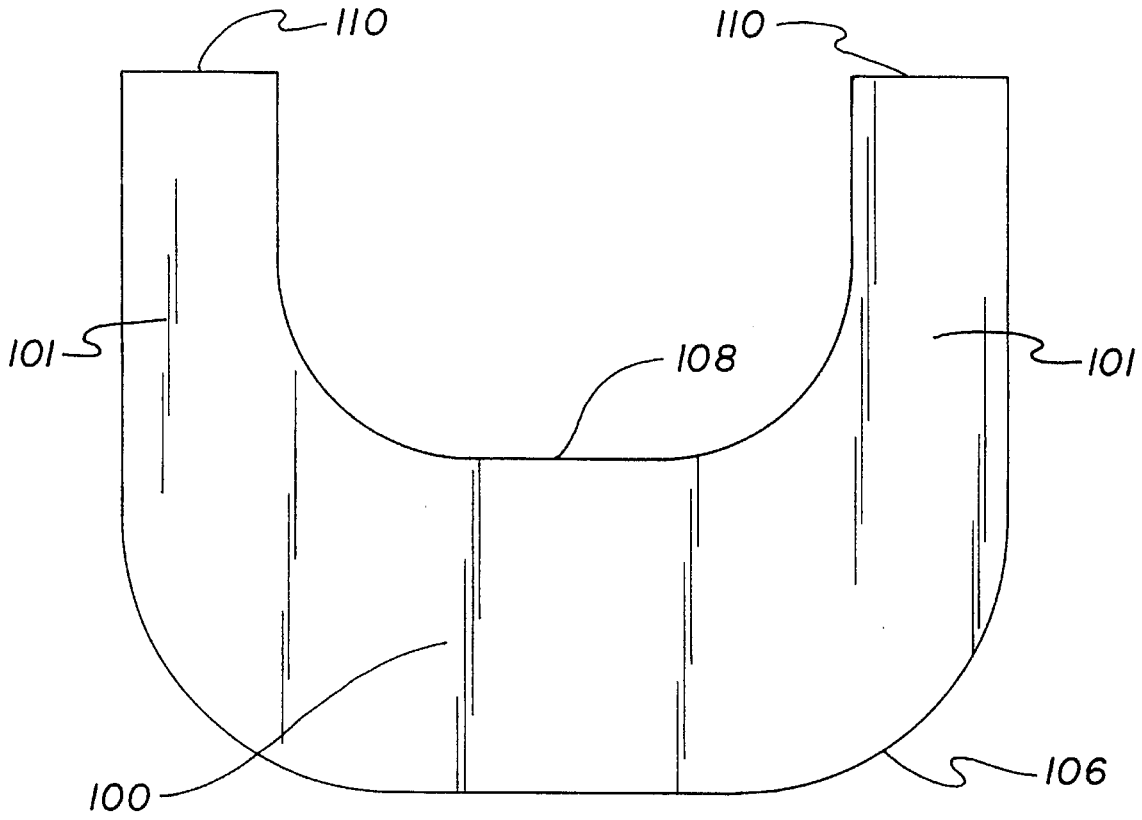
FIG. 7 is a plan view of the tray of the present invention.

A rigid and generally U-shaped planar tray 100 is provided as shown in FIGS. 2 and 7. The tray has a central portion, a pair of integral arms 101, an upper surface 102, a lower surface 104, and a periphery interconnecting the surfaces. The periphery of the tray is formed of a long curved front edge 106, a short curved back edge 108, and a pair of end edges 110. The tray additionally includes a pair of spaced parallel and elongated beams 112 coupled thereto and extended downwards from the lower surface 104 as shown in FIG. 2. The beams 112 are slidably inserted within the grooves 98 of the braces 96 on the arms 80 for removably coupling the tray at a location forward of the space 82 and the seating configuration 62.

Figure 5:
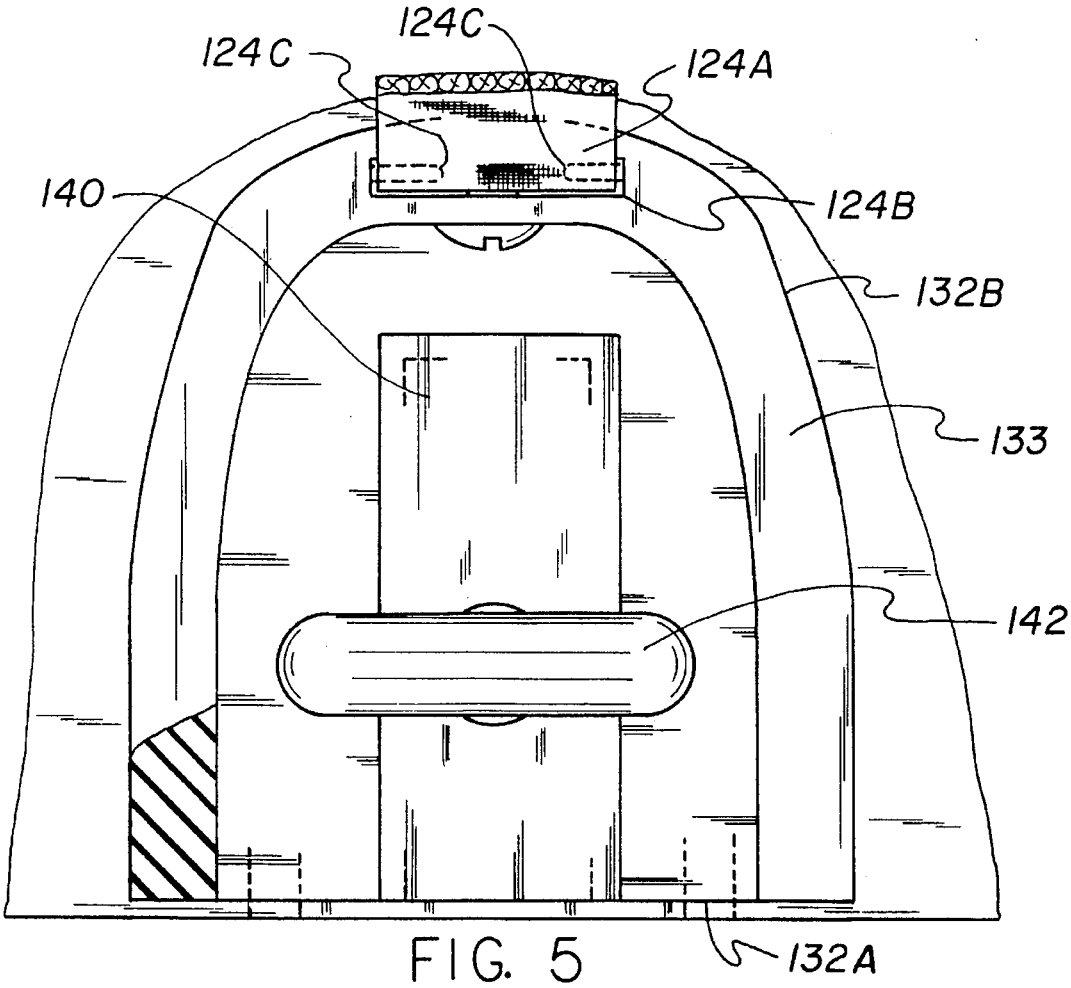
FIG. 5 is a view of the buckle of the present invention taken along the line 5—5 of FIG. 4.

Lastly, a Y-shaped shoulder harness 120 is included as shown in FIGS. 1 and 2. The shoulder harness has a pair of upper strap members 122 adjustably coupled to a lower strap member 124 with a fabric fastener 126. Each strap member has a free end. The free end of the lower strap member is formed in a loop 124A as shown in FIG. 5. Each of the free ends of the upper strap members 122 are adjustably extended through one of the slots 68 and terminated with a complementary buckle mechanism formed of a three-pronged plug 128 as shown in FIG. 2. Plug 128 is fastened on a loop 128A formed on the associated free end and is held in place with a fabric tie 129. Each plug 128 is removably securable with one of the plug sockets 71 to place strap 70 and strap members 122 and 124 in a closed loop configuration about a child's shoulder.

The shoulder harness 120 further includes a rigid latch 130 coupled to the loop 124A of the lower strap member 124 as shown in FIGS. 2 and 5. The loop 124A is disposed within a slot 124B of the latch and is removably secured with a pair of opposed and aligned pins 124C. Coupling the shoulder harness in this manner allows it to be readily removed from the seating configuration 61 for cleaning. As best illustrated in FIGS. 4 and 5, the latch 130 includes a bracket 131 with a bottom wall 132, a straight front edge 132A, a curved back edge 132B, an upstanding U-shaped side wall 133 extended upwards from the bottom wall 132 at the back edge 132B, and a rail 134 extended downwards from the bottom wall and slidably inserted within the groove 24 of the seat. The latch additionally includes a T-shaped rigid and spring-loaded bolt 136. The bolt 136 is extended through the bottom wall 128 and rail 134 through a bore 138. The bore 138 is bounded by a rigid upper entry plate 140. The bolt 136 has a handle 142 formed at an upper extent thereof and a point 144 formed at a lower extent thereof. The point 144 of the bolt is removably inserted within one of the holes 30 of the seat for placing the harness in an adjustable closed loop arrangement with respect to the space 82 and the seating configuration 62 for securing a child in a relatively fixed position.

The present invention is safer than conventional high-chairs because it employs a shoulder harness. The harness is secured to the seat back and to the seat and holds a child in a secure configuration much like a strap on a conventional car seat. The present invention is formed of a rigid impact-resistant plastic or wood. The seat and seat back can be covered with a vinyl or other water resistant material. The straps and the shoulder harness are formed of a flexible nylon or canvas material with plastic plugs, sockets, and latch.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A safety highchair for restraining a child when sitting and thereby protecting the child from falling, comprising in combination:

a generally planar rigid rectangular seat having an upper surface, a lower surface, a periphery interconnecting the surfaces formed of a short back edge, a short front edge, and a pair of opposed long side edges, the seat further having a longitudinal central axis disposed therethrough and a groove formed on the upper surface thereof and aligned along a portion of the central axis at a location near the front edge and with the groove bounded by a bottom surface portion and a pair of angled side surface portions, and with the bottom surface portion of the groove additionally having a sequence of spaced holes formed centrally therealong;

four straight rigid legs with each leg having an upper end coupled to a corner of the lower surface of the seat and with each leg extended angularly downwards and terminated at lower free end that is positionable upon a recipient supporting surface;

a rigid horizontal bracing element coupled between at least two of the legs;

a generally rectangular rigid seat back coupled to the back edge of the seat and extended upwards therefrom to define a generally L-shaped seating configuration, the seat back having an inboard surface, an outboard surface, a pair of opposed long side edges, a curved short top edge, a longitudinal central axis disposed therethrough, two pairs of spaced vertically positioned slots formed thereon and symmetrically aligned about the central axis, and a pair of spaced and horizontally aligned buckle mechanisms coupled to the outboard surface at a location below the slots and symmetrically aligned about the central axis;

a pair of rigid arms extended between the seat and the seat back to define a space therebetween for holding a sitting child, each arm having an elongated horizontal long upper rail with a back end coupled to the seat back at a location near one of the side edges thereof, a rounded free front end, and an intermediate portion therebetween, each arm further having an elongated vertical short lower rail with an upper end coupled to the intermediate portion of the upper rail and a lower end coupled to the upper surface of the seat at a location near one of the side edges thereof, and with each upper rail of each arm additionally having an elongated longitudinally positioned brace coupled thereto and with each brace having a groove formed thereon;

a rigid planar tray having an upper surface, a lower surface, and a periphery interconnecting the surfaces formed of a long curved front edge, a short curved back edge, and a pair of end edges, the tray further including a pair of spaced parallel elongated beams coupled thereto and extended downwards from the lower surface and with the beams slidably inserted within the grooves of the braces on the arms for removably coupling the tray at a location forward of the space and the seating configuration; and a Y-shaped shoulder harness including of a pair of upper strap members adjustably coupled to a lower strap member with a fastener, each strap member having a free end and with the free end of the lower strap member formed in a loop and with each of the free ends of the upper strap members extended within one of the slots and terminated with a complementary buckle mechanism, and with each complementary buckle mechanism of each upper strap member being securable with one of the buckle mechanisms of the seat to create a closed loop configuration, the shoulder harness further including a block shaped latch removably coupled to the free end of the lower strap member with a pair of opposed pins, the block shaped latch including a bracket with a bottom wall, a U-shaped sidewall extended upwards from the bottom wall, and a rail extended downwards from the bottom wall and slidably inserted within the groove of the seat, the block shaped latch additionally including a T-shaped spring-loaded rigid bolt extended through the bottom wall and rail of the bracket and with the bolt having a handle formed at an upper extent thereof and a point formed at a lower extent thereof and with the point of the bolt removably inserted within one of the holes of the seat for placing the harness in a closed loop arrangement with respect to the seating configuration.

* * * * *